United States Patent [19]

Itoh et al.

[11] Patent Number: 4,657,561

[45] Date of Patent: Apr. 14, 1987

[54] METHOD OF RECOVERING FUEL FROM COAL ASH

[75] Inventors: Hayami Itoh, Himeji; Chiaki Nagai, Kobe, both of Japan

[73] Assignee: Kawasaki Jukogyo Kabushiki Kaisha, Kobe, Japan

[21] Appl. No.: 655,981

[22] Filed: Sep. 26, 1984

Related U.S. Application Data

[63] Continuation of Ser. No. 451,626, Dec. 20, 1982.

[30] Foreign Application Priority Data

Dec. 22, 1981 [JP] Japan ..... 56-207313

[51] Int. Cl.[4] ..... C10L 1/32

[52] U.S. Cl. ..... 44/51; 44/77; 44/1 A; 44/1 R; 106/DIG. 1; 264/DIG. 49

[58] Field of Search ..... 44/51, 77, 1 A, 1 R; 406/47, 49, 197; 451/626; 106/DIG. 1; 264/DIG. 49

[56] References Cited

U.S. PATENT DOCUMENTS 2,576,565 11/1951 Brown ..... 264/DIG. 49
4,261,699 4/1981 Sun et al. ..... 44/51
4,309,190 1/1982 Baron et al. ..... 44/1 A
4,332,593 6/1982 Burgess et al. ..... 44/51

OTHER PUBLICATIONS

Littlejohn, Charles E., The Utilization of Fly Ash, Bulletin No. 6, 1954, pp. 1, and 5–42.

*Primary Examiner*—William R. Dixon, Jr.
*Assistant Examiner*—Margaret B. Medley
*Attorney, Agent, or Firm*—Jordan and Hamburg

[57] ABSTRACT

A method of recovering fuel from coal ash containing non-combusted carbon in particulate form discharged from a pulverized coal fired boiler, a fluidized bed boiler or a coal gasification furnace together with exhaust gases. In this method, water and a binder and surfactant, if necessary, are added to the ash collected by the dust collecting device, and the mixture is agitated to form coarse particles of high carbon content. Then fine particles of high ash content are separated from the coarse particles, allowing the coarse particles separated from the fine particles to be dehydrated while tailing ash is turned white in color and the ash is put to use.

11 Claims, 3 Drawing Figures

METHOD OF RECOVERING FUEL FROM COAL ASH

This application is a continuation of application Ser. No. 451,626, filed Dec. 20, 1982.

BACKGROUND OF THE INVENTION

This invention relates to a method of recovering fuel from coal ash containing non-combusted carbon in particulate form released together with exhaust gases from a pulverized coal fired boiler, a fluidized bed boiler and a coal gasification furnace, etc. and collected by a dust collecting system.

Non-combusted carbon in particulate form is contained in various types of ash including ash of combustion discharged from a pulverized coal fired boiler burning coal exclusively, together with heavy oil or in the form of a coal oil mixture (COM), ash of combustion released from a fludized bed boiler using fuel similar to those described hereinabove and residual ash released from a coal gasification furnace (hereinafter referred to as coal ash collected by a dust collecting system or simply as coal ash).

Generally, in a pulverized coal burning boiler of a coal burning steam generating plant, coal ash shows a tendency to become dark in color due to the presence of non-combusted carbon therein when coal of the type of high fuel ratio (fixed carbon/volatile component) is burned or when low NOx combustion, such as two-stage combustion, is carried out. In ordinary ash treating, coarse particles are discarded and fine particles are utilized as fly ash cement by forming a mixture with cement, for example. However, when the ash released is dark in color, such ash is not fit for cement material and all the ash should be disposed of at a loss. Darkening of the coal ash is caused by the non-combusted carbon contained in the coal ash, and when a large amount of dark ash of high carbon content is disposed of it would be a heavy loss from the point of view of fuel economy. Moreover, in the event coal burning generating plants are located near the sea because of the need to use imported coal, it is required that the release of dark ash does not cause environmental problems. A research program has been under way by us for burning coal ash at high temperature so as to enable it to be utilized even if it is produced dark in color. However, the non-combusted carbon of coal ash only accounts for about 5–20 weight % of the total amount and the production of dark ash shows violent fluctuations with time, making it difficult to incorporate a coal burning facility in a system enable waste heat to be utilized because operation of such system faces with the problem of it being low in efficiency.

On the other hand, in a fluidized bed boiler a pulverized coal burning boiler, the non-combusted component of the coal ash produced is high or in the range between 10 and 50 weight %. To cope with the high carbon content ash production, proposals have been made to use a carbon burn-up cell CBC technology. However, no satisfactory results have been achieved by this solution and those who are concerned in this technical field are hard at work to overcome the problem. Besides the ash of combustion of coal, residual ash from a coal gasification furnace, for example, is high in the proportion of a non-combusted component it contains, and it is desired that a satisfactory solution will be found.

SUMMARY OF THE INVENTION

This invention has been developed for the purpose of obviating the aforesaid disadvantages of the prior art. Accordingly, the invention has as its object the provision of a method that enables a non-combusted component of the coal ash collected by a dust collecting system to be used as a fuel after being recovered in a concentrated form while the ash tailings are too discolored to put the ash to use.

The aforesaid object can be accomplished according to the invention by adding water and a binder, and a surface-active agent (hereinafter abbreviated to surfactant), if necessary, to the coal ash collected by a dust collecting system, agitating the mixture to form coarse particles of high carbon content and separating the coarse particles from fine particles of high ash content, followed by dehydration of the coarse particles for use as a fuel.

The aforesaid agglomeration process would be considered to follow the following steps. First, the binder, such as heavy oil, added to the coal ash/water slurry, and the surfactant, added thereto when necessary, would be dispersed so that the heavy oil would get adhered to the surface of the non-combusted carbon particles to form an oil film. Then the non-combusted carbon particles would collide and be brought into contact with one another so that the particles would be united by cohesion with the oil serving as a binder into large blocks which would further grow and be compacted into coarse particles.

DETAILED DESCRIPTION OF THE PREFERRED EMBODIMENT

Figure 1:
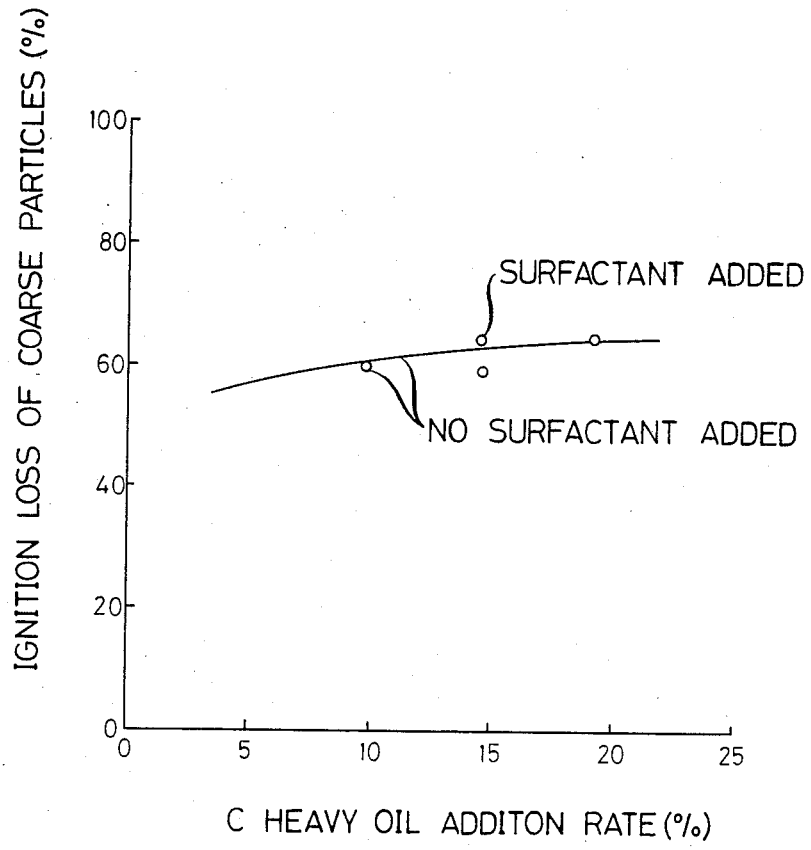
FIG. 1 is a diagrammatic representation of the ignition loss of the produced coarse particles in relation to the C heavy oil addition rate when the granulation process is carried out by adding water and C heavy oil to the coal ash and agitating the mixture.

FIG. 1 shows the results of experiments conducted by us. More specifically, it shows the ignition loss of the recovered coarse particles in relation to the addition rate of C heavy oil (the ratio of the C heavy oil to the non-combusted carbon of coal ash by weight) obtained when coal ash of an ignition loss of 21.7 weight % was used as a raw material and water and heavy oil were added thereto to effect agglomeration by agitating the mixture. When agglomeration was effected, a sieve of 88 $\mu$m mesh was used to classify coarse particles of high non-combusted carbon content from fine particles of low non-combusted carbon content which were decolored. In FIG. 1, white circles represent no addition of a surfactant and dark circles indicate addition of a surfactant. It will be seen that by adding a surfactant to the coal ash/water slurry concentration of the carbon the recovered coarse particles can be effected.

Figure 2:
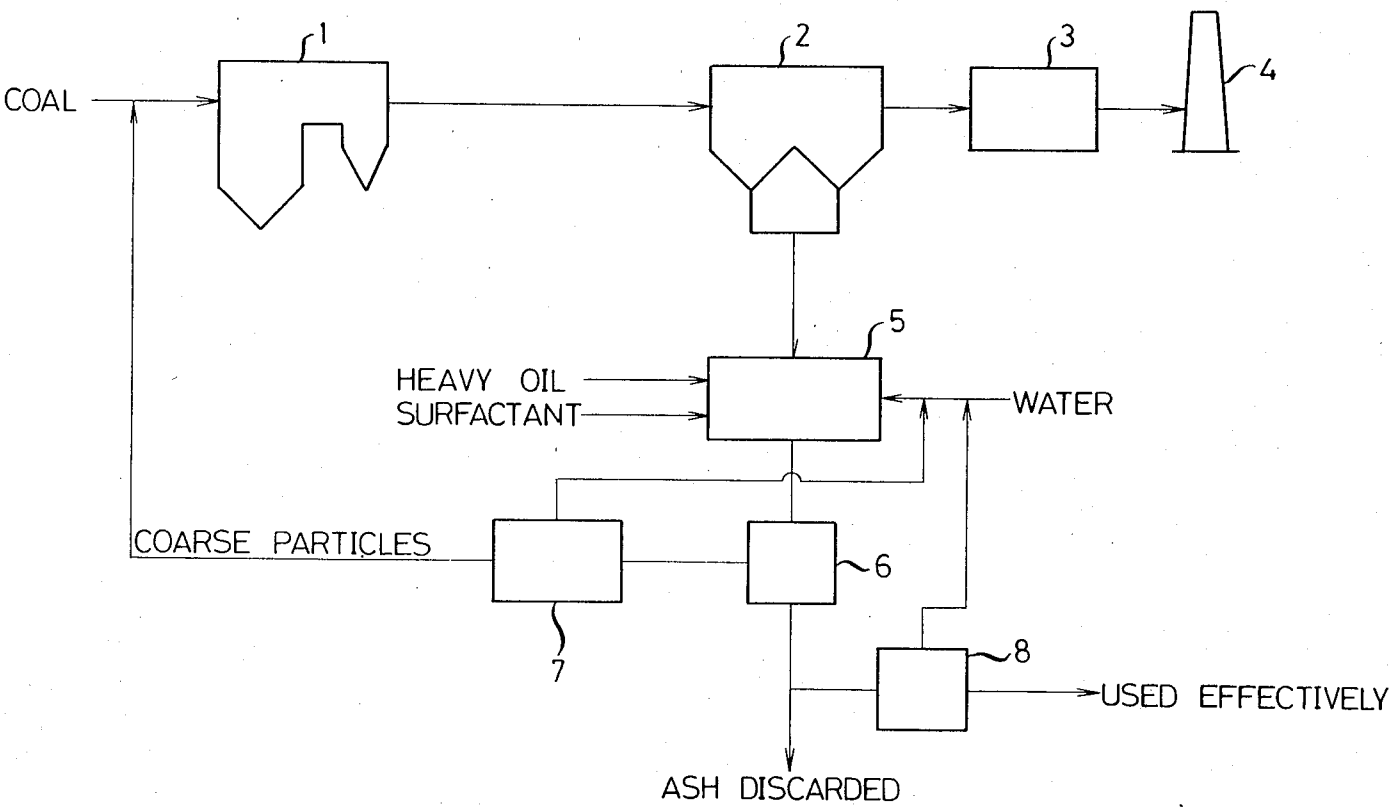
FIG. 2 is a flow chart of one example of apparatus suitable for carrying the method according to the invention into practice.

The method according to the invention will be described by referring to one example of the apparatus suitable for carrying the method into practice shown in the drawings. FIG. 2 shows one example of the aforesaid apparatus comprising a pulverized coal fired boiler 1 having connected to its exhaust duct a collecting device 2, such as an electrostatic precipitator, a desulfurizing device 3 and a stack 4 located in series with one another. The dust collecting device 2 may, in place of the electrostatic precipitator, be in the form of a granular bed filter comprising granular filter material, such as sand, gravels, ceramics, etc., movably arranged between support members including louvers, wire nettings and perforated plates or a multicyclone or a bag filter.

Exhaust gases from the pulverized coal burning boiler 1 have dust removed therefrom when they are introduced into the dust collecting device 2. When coal of high fuel ratio is burned in the pulverized coal fired boiler 1 or means provided such as two-stage combustion or mixing of the exhaust gases, are employed coal ash of dark color is likely to be produced because of high non-combusted carbon content. The coal ash collected by the dust collecting device 2 containing the coal ash of dark color is introduced into a non-combusted carbon recovery tank 5 while water and heavy oil, and a surfactant, if necessary, are added thereto. The mixture is agitated to form coarse particles of the high non-combusted carbon content and heavy oil, while leaving the ash content as high in fine particles. The coarse particles and fine particles are classified by a classifying device 6, so that the coarse particles can be used as a fuel for the pulverized coal fired boiler 1 after having water removed therefrom by a dehydrating device 7 and the water separated from the coarse particles can be used for preparation of the slurry. Meanwhile, the fine particles of high ash content separated from the coarse particles by the classifying device 6 are disposed of as a slurry in an ash dump or put to use for its ash content as a fly ash cement, for example, after being dehydrated by a solid-liquid separating device 8. The water separated might be used as water for preparation of the slurry. The non-combusted component recovery tank 5 and the classifying device 6 may be consolidated into a single device. Also the coarse particles may be temporarily stored in a tank after being dehydrated.

In the invention, the amount of the water added to the coal ash is such that the ratio of the water to the coal ash (weight ratio) is more than 1, and the binder used for agglomeration should have a viscosity of a degree sufficiently high to effect satisfactorily granulation and should be low in cost. From this point of view, C heavy oil, B heavy oil, atmospheric distillation column bottom oil and kerosene serve the purpose. The amount of the binder is in the range between 1 and 50 in weight percent in its ratio to the non-combusted component of the coal ash, preferably in the range between 5 and 25%. If the binder is too small in amount, no satisfactory effect to recover the non-combusted carbon can be achieved because of the abundance of the coal ash interfering with the agglomeration process. Conversely, if the amount of the binder added is too large, no satisfactory separating effect can be achieved and the feasibility of the process is reduced because the separated coal ash and water is contaminated with oil.

The surfactant used in the invention for accelerating agglomeration may comprise an anionic surfactant, a cationic surfactant, a nonionic surfactant and an ampholytic surfactant, used either singly or in combination. A suitable surfactant or surfactants may be selected depending on the type of burned ash. More specifically, the anionic surfactant used may be selected from the group consisting of alkybenzenesulfonate, polyoxyethylenealkysulfate, alkylsulfate, alkylphosphate, di-alkylsulfosuccinate, acrylic acid and/or maleic acid anhydride block copolymer, cyclic aromatic sulfonate and formaldehyde compounds. The cationic surfactant used may comprise alkylamine compounds and quaternary amine compounds, while the nonionic surfactant used may be selected from the group consisting of polyoxyalkyl ether, polyoxyethylenephenol ether, oxyethylene-oxypropylene block-copolymer, polyoxyethylenealkylamine, sorbitan fatty acid ester and polyoxyethylenesorbitan fatty acid ester. The ampholytic surfactant used may be selected from the group consisting of alkylbetaine and amine compounds including 1,2,3-monoamine or diamine. The amount of the surfactant used for effective granulation is 0.01–5.0 weight percent of the non-combusted component of the ash, preferably 0.05–2.0 weight percent.

The invention will now be described be referring to its preferred embodiments.

EXAMPLE 1

Water having the ratio 2 of water to coal ash in weight percent and C heavy oil of 15 weight percent with respect to the non-combusted component of ash were added to coal ash (with an ignition loss of 21.7 weight %) collected by the dust collecting device of a pulverized coal fired boiler, and the mixture was agitated at 800 rpm. Then the mixture was classified by means of a seive of 88 μm into coarse particles and fine particles. The recovered coarse particles had an ignition loss of 60%, and the fine particles were decolored.

EXAMPLE 2

To the coal ash used in Example 1 were added water having the ratio 2 of water to coal ash in weight percent, C heavy oil of 15 weight percent with respect to the non-combusted component of the coal ash and an anionic surfactant of 10 weight percent with respect to the non-combusted component of the coal ash, and the mixture was agitated at 800 rpm. Then the mixture was classified into coarse particles and fine particles by means of a sieve of 88 μm. The recovered coarse particles had an ignition loss of 64 weight % and the fine particles were decolored.

Figure 3:
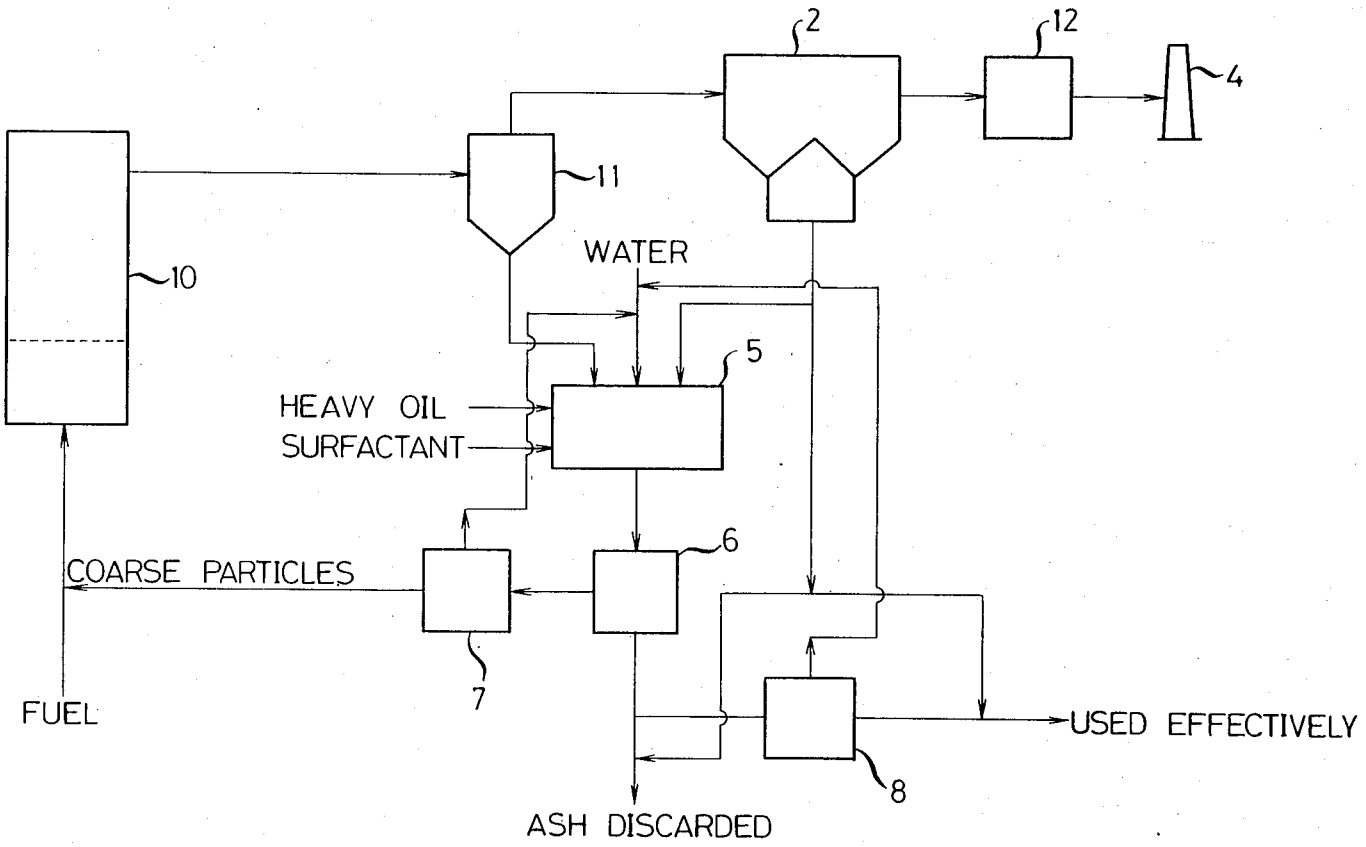
FIG. 3 is a flow chart of another example of apparatus suitable for carrying the method according to the invention into practice

FIG. 3 shows a fluidized bed boiler 10 suitable for carrying the method according to the invention into practice. Exhaust gases released from the fluidized bed boiler 10 are first led to a multicyclone 11 wherein coal ash of large particles is removed from the exhaust gases. The fine ash particles are removed by a dust collecting device 2, such as an electrostatic precipitator. 12 is an air preheater. The coal ash collected by the multicyclone 11 and electrostatic precipitator is led to a non-combusted carbon recovery tank 5 where water and heavy oil, and a surfactant, if necessary, are added to the ash and granulation is carried out. In place of introducing the ash collected by the dust collecting device 2, such as an electrostatic precipitator, into the non-combusted component separating tank 5 together with the ash collected by the multicyclone, the former may be led to a separate and independent non-combusted component separating tank to carry out granulation therein. The ash collected by the dust collecting device 2 may be disposed of without being subjected to granulation or the ash may be put to use. The parts of the system shown in FIG. 3 are similar to those shown in FIG. 2.

The invention enables the noncombusted component of coal ash to be recovered in concentrated form, to thereby eliminate the carbon burn-up cell hitherto been used for treating coal ash discharged from a fluidized bed boiler.

What is claimed is:

1. A method for recovering useful solid fuel from coal ash of combustion which comprises:

(a) collecting ash of combustion separately from exhaust gases both formed in a thermal recovery unit where previously comminuted solid particulate coal is combusted with air whereby heat is generated, which ash of combustion consists essentially of non-combusted carbon and non-carbon ash product both in solid particulate form, the non-combusted carbon having undergone denaturation caused inherently by the heat;

(b) adding water, a binder, and a surfactant to the collected ash of combustion, the amount of said water added to said ash being greater than a 1:1 weight ratio with respect to said ash, said binder being a high viscosity heavy hydrocarbon oil, the amount of said oil added to said ash being in the range between about 1 to 50 weight percent with respect to the amount of non-combusted carbon in said ash, said surfactant being selected from the group consisting of an anionic surfactant, a cationic surfactant, a nonionic surfactant, an ampholytic surfactant, and mixtures thereof, the amount of said surfactant added to said ash being in the range between about 0.01 to 5.0 weight percent with respect to the amount of non-combusted carbon in said ash;

(c) agitating the mixture formed by step (b) thereby to produce preferential agglomeration of the non-combusted carbon in particulate form into coarse particles of high carbon content leaving the non-carbon ash product substantially as it stands;

(d) subjecting the mixture formed by step (c) to separation so that the coarse particles of high carbon content are collected separately from the non-carbon ash product;

(e) recovering the coarse particles of high carbon content for use as a solid fuel; and (f) recovering the non-carbon ash product.

2. The method for recovering useful solid fuel from coal ash of combustion of claim 1, in which the thermal recovery unit is selected from the group consisting of a pulverized coal fired boiler, a fluidized bed boiler, and a coal gasification furnace.

3. The method for recovering useful solid fuel from coal ash of combustion of claim 1, in which the amount of heavy hydrocarbon oil added according to step (b) is in the range of between about 5 to 25 weight percent, with respect to the amount of non-combusted carbon in the ash.

4. The method for recovering useful solid fuel from coal ash of combustion of claim 1, in which the heavy hydrocarbon oil is selected from the group consisting of C heavy oil, B heavy oil, atmospheric distillation column bottom oil, and kerosene.

5. The method for recovering useful solid fuel from coal ash of combustion of claim 1, in which the amount of surfactant added according to step (b) is in the range of between about 0.05 to 2.0 weight percent, with respect to the amount of non-combusted carbon in the ash.

6. The method for recovering useful solid fuel from coal ash of combustion of claim 1, in which the surfactant is an anionic surfactant selected from the group consisting of alkylbenzenesulfonate, polyoxyethylene alkylsulfate, alkylsulfate, alkylphosphate, di-alkylsulfosuccinate, acrylic acid and/or maleic acid anhydride block-copolymer, cyclic aromatic sulfonate, and formaldehyde compounds.

7. The method for recovering useful solid fuel from coal ash of combustion of claim 1, in which the surfactant is a cationic surfactant selected from the group consisting of alkylamine compounds and quaternary amine compounds.

8. The method for recovering useful solid fuel from coal ash of combustion of claim 1, in which the surfactant is a nonionic surfactant selected from the group consisting of polyoxyalkyl ether, polyoxyethylenealkylphenol ether, polyoxyethylenephenol ether, oxyethylene-oxypropylene block-copolymer, polyoxyethylenealkylamine, sorbitan fatty acid ester, and polyoxyethylenesorbitan fatty acid ester.

9. The method for recovering useful solid fuel from coal ash of combustion of claim 1, in which the surfactant is an ampholytic surfactant selected from the group consisting of alkylbetaine and amine compounds.

10. The method of claim 1 wherein said non-carbon ash product of the step (f) is mixed with at least one cement constituent to form a cement product.

11. The method of claim 1 wherein said useful solid fuel product of step (e) is combusted with said previously comminuted solid particulate coall in said thermal recovery unit of step (a).

* * * * *